US012091230B2

(12) United States Patent
McGarry et al.

(10) Patent No.: US 12,091,230 B2
(45) Date of Patent: Sep. 17, 2024

(54) STORAGE AND DISPLAY ASSEMBLY FOR A SHAVING RAZOR SYSTEM

(71) Applicant: The Gillette Company LLC, Boston, MA (US)

(72) Inventors: Rory Frederick Wellington McGarry, Boston, MA (US); Brian Patrick Watson, Marshfield, MA (US)

(73) Assignee: The Gillette Company LLC, Boston, MA (US)

( * ) Notice: Subject to any disclaimer, the term of this patent is extended or adjusted under 35 U.S.C. 154(b) by 0 days.

(21) Appl. No.: 17/328,406

(22) Filed: May 24, 2021

(65) Prior Publication Data

US 2021/0362930 A1 Nov. 25, 2021

Related U.S. Application Data

(60) Provisional application No. 63/028,910, filed on May 22, 2020.

(51) Int. Cl.
*B65D 77/20* (2006.01)
*A45D 27/22* (2006.01)
(Continued)

(52) U.S. Cl.
CPC ..... *B65D 77/2024* (2013.01); *A45D 27/22* (2013.01); *B65D 25/10* (2013.01);
(Continued)

(58) Field of Classification Search
CPC .... B65D 77/2024; B65D 25/10; B65D 25/22; B65D 51/245; B65D 2203/02; B65D 2577/205; A45D 27/22
(Continued)

(56) References Cited

U.S. PATENT DOCUMENTS 1,493,097 A 5/1924 Blood
1,513,776 A 11/1924 Cheney
(Continued)

FOREIGN PATENT DOCUMENTS

DE 7239038 U 2/1973
DE 202013008189 U1 12/2014
(Continued)

OTHER PUBLICATIONS

U.S. Appl. No. 29/770,348, filed Feb. 11, 2021, Rory Frederick Wellington McGarry et al.
(Continued)

*Primary Examiner* — Chun Hoi Cheung
(74) *Attorney, Agent, or Firm* — John M. Lipchitz

(57) ABSTRACT

A storage and display assembly for a shaving razor system. The assembly comprising has a case with a top portion and a bottom portion. The top and bottom portions being coupled together so as to be movable relative to one another between a closed position and an open position. The top and bottom portions, when in the closed position, define an inner cavity sized to receive the shaving razor system. A securement cover associated with the top and bottom portions to maintain the top and bottom portions in the to be moved to the open position. The securement cover comprises at least one of product indicia closed position. The securement cover being removable from the case to allow the top and bottom portions or product imagery.

15 Claims, 8 Drawing Sheets

(51) Int. Cl.
*B65D 25/10* (2006.01)
*B65D 25/22* (2006.01)
*B65D 51/24* (2006.01)

(52) U.S. Cl.
CPC ..... *B65D 25/22* (2013.01); *B65D 51/245* (2013.01); *B65D 2203/02* (2013.01); *B65D 2577/205* (2013.01)

(58) Field of Classification Search
USPC ..... 206/459.5, 459.1, 493, 349–383, 485.1, 206/434, 208, 775, 497; 229/125.125, 229/125.05, 103.2
See application file for complete search history.

(56) References Cited

U.S. PATENT DOCUMENTS 1,536,468 A 5/1925 Behrman
2,735,542 A * 2/1956 Shnitzler ..... B65D 85/54 220/840
2,925,905 A 2/1960 Metzler et al.
3,095,965 A 7/1963 Gerald et al.
3,206,012 A 9/1965 Braginetz
3,366,268 A 1/1968 Heinz
3,381,873 A 5/1968 Kashichi
3,613,873 A 10/1971 Schulman
3,999,661 A 12/1976 Jones
D259,596 S 6/1981 Gray
D261,950 S 11/1981 Jankowski
D262,585 S 1/1982 Anema
5,123,527 A * 6/1992 Hustad ..... B65D 71/34 206/769
5,590,779 A 1/1997 Ramsey
D380,900 S 7/1997 Gohil
5,782,346 A 7/1998 Gray et al.
D414,036 S 9/1999 Conway
D425,296 S 5/2000 Shurtleff
D430,727 S 9/2000 Wisniewski
6,371,318 B1 4/2002 Riffer
6,394,337 B1 * 5/2002 Ross ..... B65D 75/06 206/427
6,399,170 B1 6/2002 Hock et al.
6,415,517 B1 7/2002 Worrick, III
7,159,324 B2 1/2007 Worrick, III
7,468,498 B2 * 12/2008 Tuszkiewicz ..... B65D 81/3453 426/243
D588,908 S 3/2009 Silvenis
D596,953 S 7/2009 Wonderley et al.
D615,708 S 5/2010 Lukan
D625,913 S 10/2010 Phillips
7,858,027 B2 12/2010 Trissel
D636,531 S 4/2011 Wilson
D656,676 S 3/2012 Cavazos et al.
D681,938 S 5/2013 Pan
D700,995 S 3/2014 Lee et al.
D700,996 S 3/2014 Lee et al.
D724,269 S 3/2015 Szczepanowski et al.
D739,980 S 9/2015 Psimadas
D745,775 S 12/2015 Provost et al.
D764,102 S 8/2016 Christie et al.
D805,251 S 12/2017 Newlin
D807,582 S 1/2018 Christofidellis
10,059,495 B1 8/2018 Korustan et al.
D829,993 S 10/2018 Hage et al.
D842,542 S 3/2019 Ramm et al.
D842,543 S 3/2019 Ramm et al.
D842,544 S 3/2019 Ramm et al.
D846,264 S 4/2019 Wu
D857,991 S 8/2019 Atlason et al.
D880,063 S 3/2020 Ramm
D887,082 S 6/2020 Zaremba
D895,268 S 9/2020 Goeder
D895,960 S 9/2020 Goeder
D908,960 S 1/2021 Ramm et al.
D910,917 S 2/2021 Ramm et al.
D911,607 S 2/2021 McGarry et al.
D911,608 S 2/2021 Riehle et al.
D913,592 S 3/2021 Mcgarry et al.
D921,294 S 6/2021 Mcgarry et al.
D936,287 S 11/2021 Huang et al.
D950,153 S 4/2022 Ramm
D952,254 S 5/2022 Hurtado et al.
D967,530 S 10/2022 Riehle et al.
D967,531 S 10/2022 Mcgarry et al.
D967,532 S 10/2022 Mcgarry et al.
2003/0047474 A1 * 3/2003 Dahlson ..... B65D 75/24 47/84
2003/0101525 A1 6/2003 Belloli
2003/0209457 A1 11/2003 Coffin et al.
2005/0218033 A1 10/2005 Curtis
2006/0102509 A1 5/2006 Powers et al.
2007/0141199 A1 6/2007 Ishikawa et al.
2009/0120816 A1 * 5/2009 Ruman ..... B65D 5/62 206/459.5
2010/0307116 A1 * 12/2010 Fisher ..... B65D 77/20 206/505
2010/0313425 A1 12/2010 Hawes
2011/0068044 A1 * 3/2011 Sorrentino ..... B65D 71/22 229/162.1
2011/0119923 A1 5/2011 Nicoll et al.
2011/0139660 A1 * 6/2011 Cabell ..... B65D 21/048 156/212
2011/0284403 A1 * 11/2011 Hendryx ..... B65D 5/541 206/459.5
2013/0291390 A1 11/2013 Gajria et al.
2013/0333796 A1 12/2013 Py
2015/0047481 A1 2/2015 Nicoll et al.
2015/0059197 A1 3/2015 Sassano
2015/0076025 A1 * 3/2015 Wilmers ..... B65D 21/0201 220/608
2015/0265019 A1 9/2015 Niedzwiecki et al.
2016/0121497 A1 5/2016 Johnson
2017/0196342 A1 7/2017 Martin
2017/0232442 A1 8/2017 Valaskovic et al.
2018/0079581 A1 3/2018 Marquette
2018/0134466 A1 5/2018 Oliveira et al.
2018/0160790 A1 6/2018 Swatty et al.
2019/0193293 A1 6/2019 Peach
2021/0061537 A1 3/2021 Riley et al.
2021/0259384 A1 8/2021 Mcgarry et al.

FOREIGN PATENT DOCUMENTS

EP 0001260 A1 4/1979
EP 1843878 B1 4/2010
EP 3348363 B1 7/2019
FR 2841223 A1 12/2003
JP S58112969 A 7/1983
WO 2011149723 A1 12/2011

OTHER PUBLICATIONS

U.S. Appl. No. 29/704,182, filed Sep. 3, 2019, Rory Frederick Wellington McGarry et al.
PCT Search Report and Written Opinion for PCT/US2021/033323 dated Sep. 2, 2021.
All Office Actions; U.S. Appl. No. 29/701,131.
All Office Actions; U.S. Appl. No. 29/770,348.
All Office Actions; U.S. Appl. No. 16/800,145.
All Office Actions; U.S. Appl. No. 29/704,182.
U.S. Appl. No. 16/800,145, filed Feb. 25, 2020, to Rory Frederick Wellington McGarry et. al.
U.S. Appl. No. 29/889,292, filed Apr. 11, 2023, Rory Frederick Wellington McGarry et al.
All Office Actions; U.S. Appl. No. 29/889,292, filed Apr. 11, 2023.

* cited by examiner

STORAGE AND DISPLAY ASSEMBLY FOR A SHAVING RAZOR SYSTEM

FIELD OF THE INVENTION

The invention generally relates to a storage and display assembly for a shaving razor system, and more particularly to a case and securement cover for storing and displaying one or more components of a shaving razor system.

BACKGROUND OF THE INVENTION

In recent years, consumers have become increasingly aware of the environmental impact of product packaging and have begun to call for more sustainable and cost-effective packaging. Many conventional product packaging options for handheld personal care products such as shaving razors are not durable or reusable and include a significant amount of single-use material that is discarded after the product is purchased by a consumer and removed from the packaging. While at least some of this material is typically recyclable, some types of materials are not easily recyclable in consumer recycling streams, and other material types are not recyclable at all. Packaging options with one or more reusable portions frequently are insufficiently robust and may degrade with use or become damaged, particularly following contact with liquids such as water, soap, etc. These structures typically also provide limited ability for cleaning and may lose the ability to secure and/or protect the product over time.

It would be desirable to provide durable, multi-use packaging for a shaving razor system that could be used both to display the product in a retail environment and store the product during consumer use.

SUMMARY OF THE INVENTION

In one aspect, the invention features, in general, a storage and display assembly for a shaving razor system. The assembly comprising has a case with a top portion and a bottom portion. The top and bottom portions being coupled together so as to be movable relative to one another between a closed position and an open position. The top and bottom portions, when in the closed position, define an inner cavity sized to receive the shaving razor system. A securement cover associated with the top and bottom portions to maintain the top and bottom portions in the to be moved to the open position. The securement cover comprises at least one of product indicia closed position. The securement cover being removable from the case to allow the top and bottom portions or product imagery.

In another aspect, the invention features, in general, a method for merchandizing a shaving razor system. A case with a top portion and a bottom portion are provided that are coupled together so as to be movable relative to one another between open and closed positions. The shaving razor system is placed into an inner cavity of the case. The case is secured in the closed position by associating a securement cover with the top and bottom portions of the case. At least one of product indicia or product imagery is provided on the securement cover. The securement cover is associated with the case such that the at least one of product indicia or product imagery is visible. The case is displayed with the securement cover.

BRIEF DESCRIPTION OF THE DRAWINGS

While the specification concludes with claims particularly pointing out and distinctly claiming the subject matter which is regarded as forming the present invention, it is believed that the invention will be better understood from the following description which is taken in conjunction with the accompanying drawings in which like designations are used to designate substantially identical elements, and in which:

DETAILED DESCRIPTION OF THE INVENTION

Figure 1:
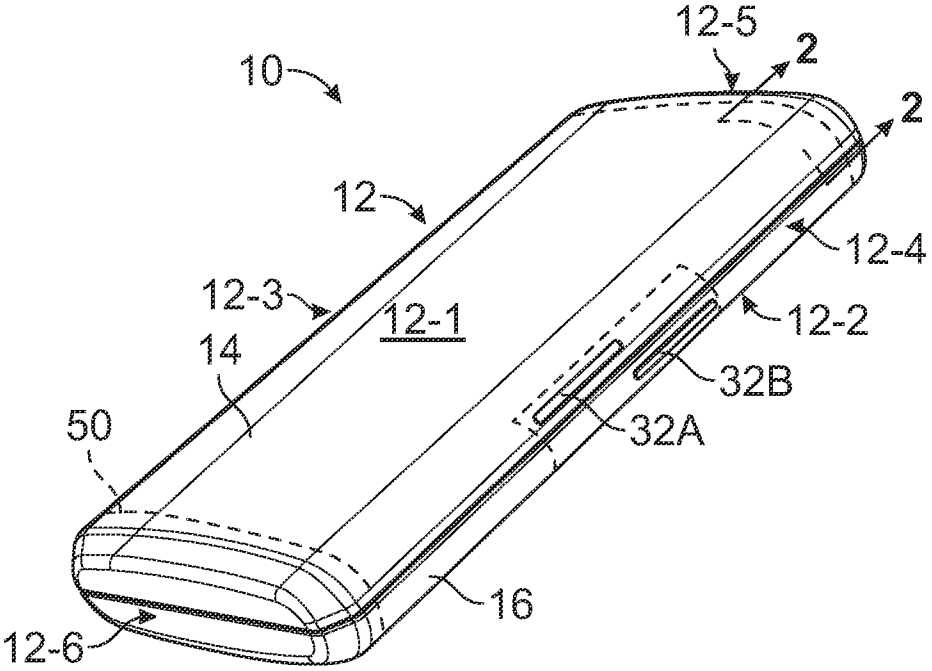
FIG. 1 is a perspective view of a storage and display assembly for a shaving razor system, in accordance with the present disclosure, in which a case is in a closed position.
Figure 3:
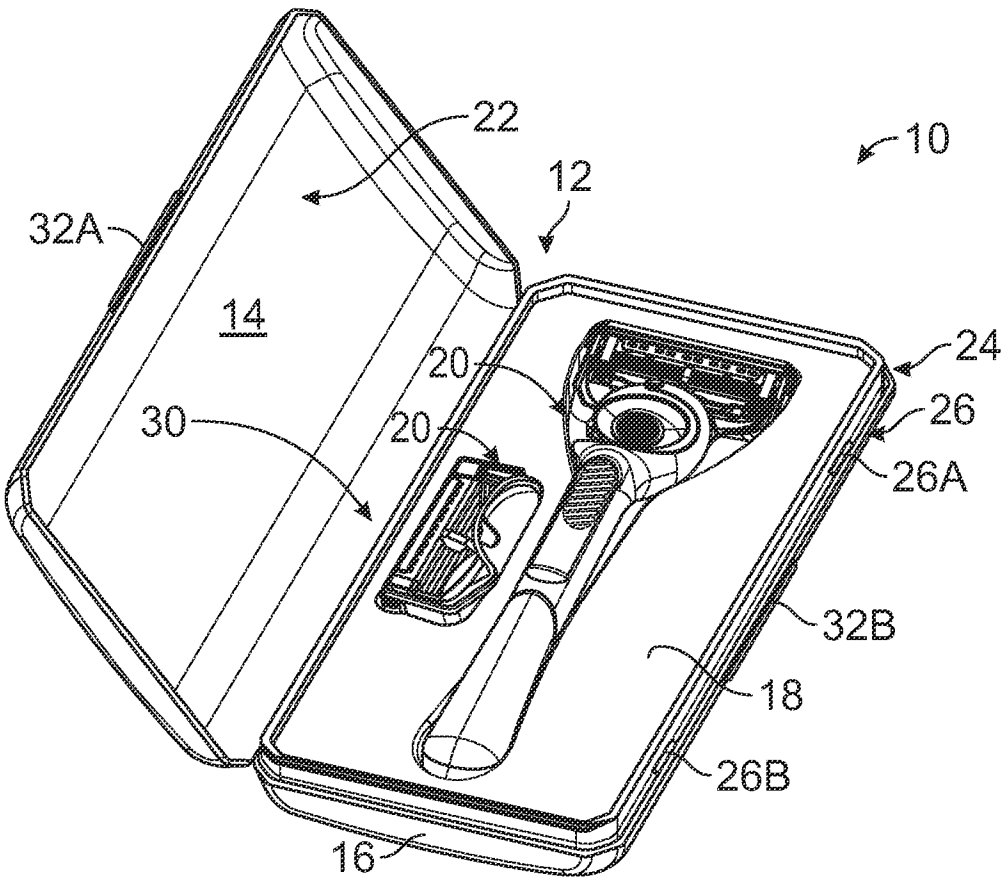
FIG. 3 is a perspective view of a storage and display assembly for a shaving razor system, in accordance with the present disclosure, in which a case is in an open position.

With reference to FIG. 1, a storage and display assembly 10 is illustrated. The storage and display assembly 10 comprises a case 12 and a securement cover 50 (an outline of the securement cover 50 is depicted with dashed lines). The case 12 comprises a top portion 14 and a bottom portion 16 that may be coupled together so as to be movable relative to one another between a closed position, as shown in FIG. 1, and an open position, as shown in FIG. 3. When the case 12 is in the closed position, the case 12 defines a top surface 12-1; a bottom surface 12-2; a pair of side surfaces comprising a first side surface 12-3 and a second side surface 12-4; and a pair of end surfaces comprising a first end surface 12-5 and a second end surface 12-6. As described herein in detail, the securement cover 50 may be associated with the top and bottom portions 14 and 16 of the case 12 to maintain the top and bottom portions 14 and 16 in the closed position. As used herein, "display" may refer to a case 12 and a securement cover 50, in which the securement cover 50 maintains the case 12 in a closed condition and the case 12 and the securement cover 50 together provide a final product suitable for display on a shelf without a hang tag or on a rack with a hang tag.

As shown in FIG. 3, the storage and display assembly 10 is for a shaving razor system 20 (in FIG. 3, the securement cover 50 has been removed from the assembly 10, as explained in detail herein). The top and bottom portions 14 and 16 of the case 12, when in the closed position, define an inner cavity 22 that may be sized to receive one or more components of the shaving razor system 20. An insert 18 may be received in the bottom portion 16 of the case 12 and may comprise one or more cavities (not labeled) configured to receive the component(s) of the shaving razor system 20, see also FIG. 2. The top and bottom portions 14 and 16 of the case 12 may each comprise a durable material such as an engineering plastic, such as a polycarbonate, a metal, or a metal alloy, such as steel, aluminum, tin, or combinations thereof. The case 12 may provide a sturdy, multi-use container that protects the components of the shaving razor system 20. The case 12 may also serve as a durable and convenient storage and travel kit in a home environment and may be used to hold, organize, and store the razor handle, additional cartridge(s), and/or accessories for day-to-day use.

In some examples, as shown in FIG. 3, the case 12 may comprise a clamshell configuration in which the top portion 14 may be coupled to the bottom portion 16 by a hinge 30 that extends along a portion of a longitudinal length (not labeled) of the case 12. In other examples (not shown), the case 12 may comprise an alternative clamshell configuration in which the top and bottom portions 14 and 16 are coupled together by a hinge that extends along a portion of a lateral width (not labeled) of the case 12. In further examples (not shown), one of the top and the bottom portion 14 and 16 may be slidably received in the other of the top and the bottom portion 14 and 16.

Figure 2:
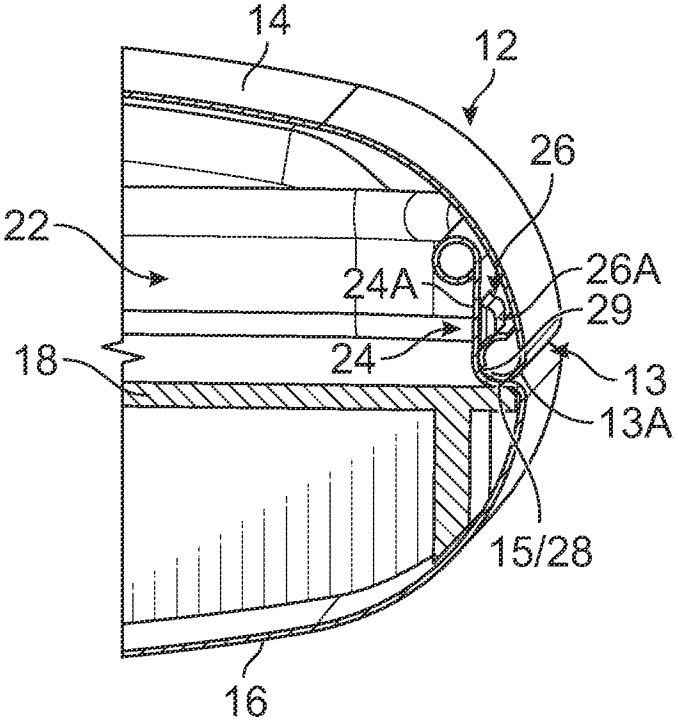
FIG. 2 is a cross-sectional view taken along line 2-2 in FIG. 1.

With reference to the example shown FIGS. 2 and 3, the bottom portion 16 may comprise an indent 24 that may extend around at least a section of an outer peripheral part (not labeled) of the bottom portion 16. The top portion 14 may comprise an outer peripheral part 13 that extends around the entirety of the top portion 14. When the case 12 is moved from the open position shown in FIG. 3, to the closed position shown in FIG. 2, at least a section 13A of the outer peripheral part 13 of the top portion 14 may extend over and be received in the indent 24 formed in the bottom portion 16. The top and bottom portions 14 and 16 may be secured together and the case 12 may be maintained in the closed position, at least in part, by an interference fit between the top and bottom portions 14 and 16, as discussed in further detail below.

The case 12 may comprise a locking feature that helps to maintain the top and bottom portions 14 and 16 in the closed position. With continued reference to FIGS. 2 and 3, one portion, e.g., the bottom portion 16, of the case 12 may comprise a first locking element 26 that may be adapted to releasably engage with a second locking element 28 on the other portion, e.g., the top portion 14, of the case 12 to releasably lock the top and bottom portions 14 and 16 in the closed position. The first locking element 26 may comprise, for example, first and second protrusions 26A, 26B located within and extending outwardly from a recessed wall 24A defining the indent 24, and the second locking element 28 may comprise, for example, a curled peripheral edge 15 defining one or more sections 13A of the outer peripheral part 13 of the top portion 14. It is understood that the bottom portion 16 may comprise, instead of two protrusions, one protrusion or three or more protrusions and that the protrusion(s) may be positioned at any suitable location in the indent 24. The curled peripheral edge 15 may define an entirety of the outer peripheral part 13 of the top portion 14 or may define only one or more discrete section(s) 13A of the outer peripheral part 13 of the top portion 14, e.g., near the protrusion(s) 26A, 26B.

The material comprising the top and bottom portions 14 and 16, the protrusion(s) 26A, 26B, and/or the peripheral edge 15 may be sufficiently flexible such that when the top and bottom portions 14 and 16 are pressed together to move the case 12 to the closed position, the peripheral edge 15 passes over the protrusion(s) 26A, 26B and engages a portion 29 of the indent 24 below the protrusion(s) 26A, 26B to releasably lock the top and bottom portions 14 and 16 in the closed position via an interference or snap fit between the first and second locking elements, as shown in FIG. 2.

The case 12 may comprise one or more gripping features 32A and 32B, each comprising a longitudinally extending and outwardly projecting protrusion in the illustrated example, configured to assist with moving the case 12 from the closed position to the open position. With reference to FIG. 1, the top portion 14 of the case 12 may comprise one or more first gripping features 32A, and the bottom portion 16 of the case 12 may comprise one or more second gripping features 32B. A user may engage the gripping features 32A and 32B with his or her fingers and move the first gripping feature 32A in an opposite direction from the second gripping feature 32B to separate the top portion 14 of the case 12 from the bottom portion 16.

Figure 4:
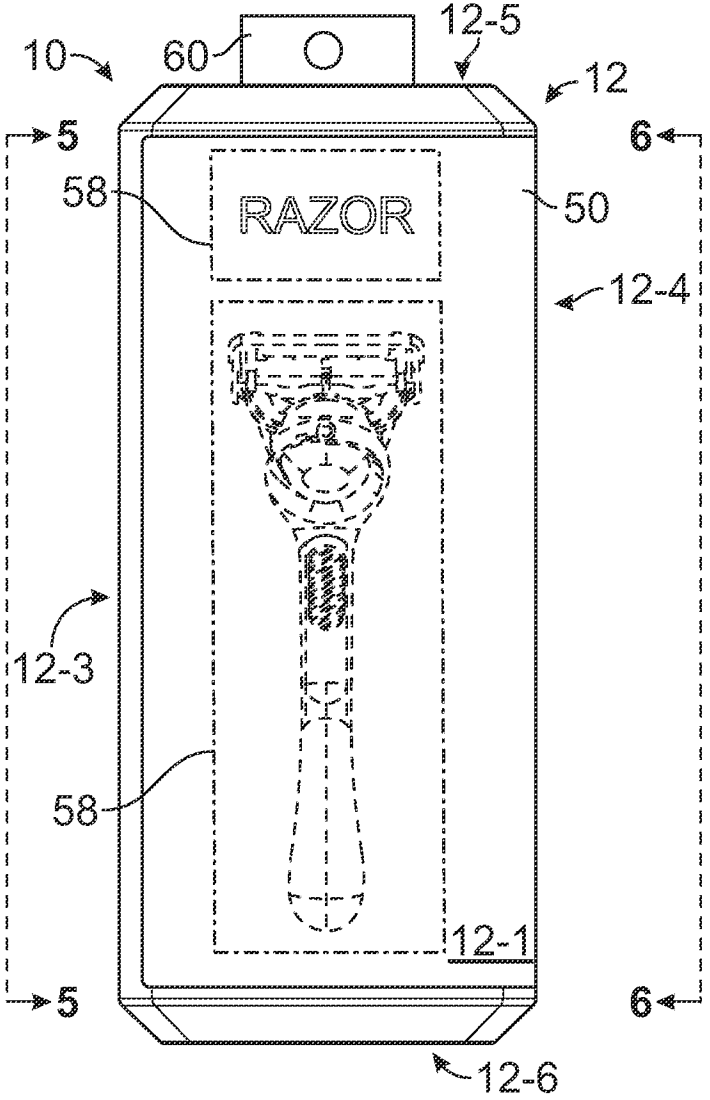
FIG. 4 is a plan view of a storage and display assembly for a shaving razor system comprising a securement cover, in accordance with the present disclosure.
Figure 5:
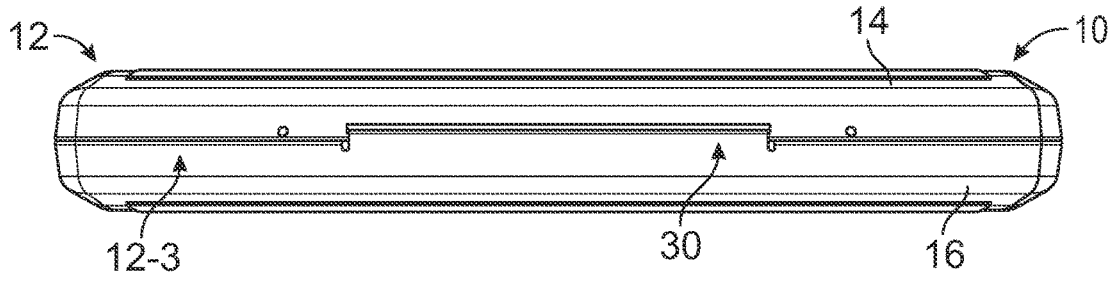
FIG. 5 is a side view taken along view line 5-5 in FIG. 6.
Figure 6:
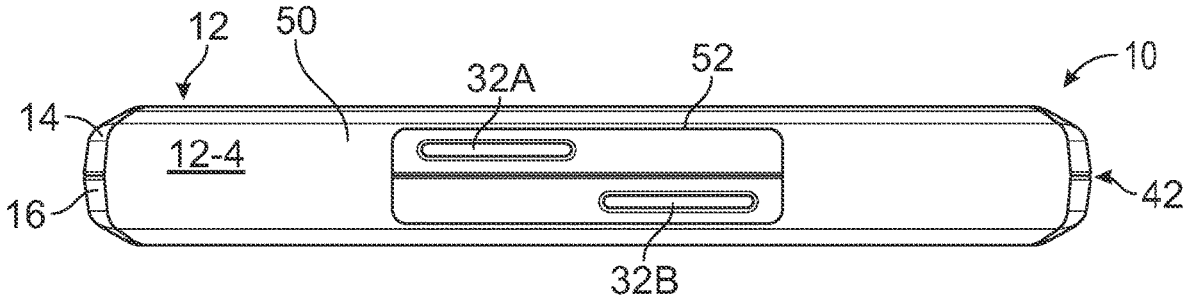
FIG. 6 is a side view taken along view line 6-6 in FIG. 4.

FIGS. 4-6 illustrate additional details of the securement cover 50 in FIG. 1. With reference to FIGS. 4 and 5, the securement cover 50 may extend over at least a part of the top and bottom portions 14 and 16 of the case 12 and may extend over at least a portion of the top surface 12-1, the second side surface 12-4, and the bottom surface 12-2. The securement cover 50 may comprise one or more polymeric and/or paper materials such as paperboard. At least a section of the securement cover 50 may be secured to the case 12 with a pressure-sensitive adhesive. For example, the securement cover 50 may be adhered to portions of the top, bottom, and/or second side surfaces 12-1, 12-2, and 12-4 of the case 12. In some examples, the securement cover 50 may comprise a pressure sensitive label.

The storage and display assembly 10 of FIG. 4 may optionally comprise a hang tag 60 associated with one of the case 12 or the securement cover 50. The hang tag 60 may be coupled to the case 12 or the securement cover 50, e.g., via adhesive or other suitable attachment means, or may be formed as part of the case 12 or the securement cover 50. The hang tag 60 may be removable. The hang tag 60 may be configured to allow the storage and display assembly 10, i.e., the case 12 and the securement cover 50, to be displayed and/or stored. The hang tag 60 may comprise an aperture that allows the storage and display assembly 10 to be associated with a display and/or storage system (not shown) by, for example, hanging the storage and display assembly 10 from a hook or peg. The securement cover 50 may comprise at least one of product indicia or product imagery 58. The product indicia and/or product imagery 58 may comprise one or more of text describing a product (e.g., the shaving razor system 20), pictures or other graphics depicting the product, instructions, trademarks and/or service marks related to product, and other branding information. The product indicia and/or product imagery 58 may be printed, stamped, engraved, embossed, etc. on the securement cover 50.

As shown in FIG. 4, at least a portion of the first and second end surfaces 12-5 and 12-6 of the case 12 may spaced apart from the securement cover 50. As used herein, the phrase "spaced apart" means that the underlying portion (s) of the case 12 are not covered by the securement cover 50. For example, the securement cover 50 may be configured such that the securement cover 50 does not extend onto the first and second end surfaces 12-5 and 12-6 of the case 12.

As shown in FIG. 5, the hinge 30 may also be spaced apart from the securement cover 50. For example, the securement cover 50 may stop short of the first side surface 12-3 so that the hinge 30 is not covered.

As shown in FIG. 6, the securement cover 50 may extend over at least a portion of the second side surface 12-4 of the case 12 and across at least a section of a junction 42 between the top and bottom portions 14 and 16 of the case 12 so that the case 12 may be maintained in the closed position. The securement cover 50 may comprise an opening 52 that may be positioned over the first and second gripping features 32A and 32B, such that the gripping features 32A and 32B are spaced apart from the securement cover 50. It may be desirable for the hinge 30 and/or the gripping features 32A and 32B to be spaced apart from the securement cover 50 to prevent adhesive from entering the hinge 30 and/or leaving a sticky residue on the hinge 30 and/or gripping features 32A and 32B. The case 12 may be opened by grasping a portion, e.g., an edge, of the securement cover 50 and removing, e.g., peeling, at least a portion of the securement cover 50 from the case 12 to allow the top and bottom portions 14 and 16 to be moved to the open position (see FIG. 3).

Figure 7:
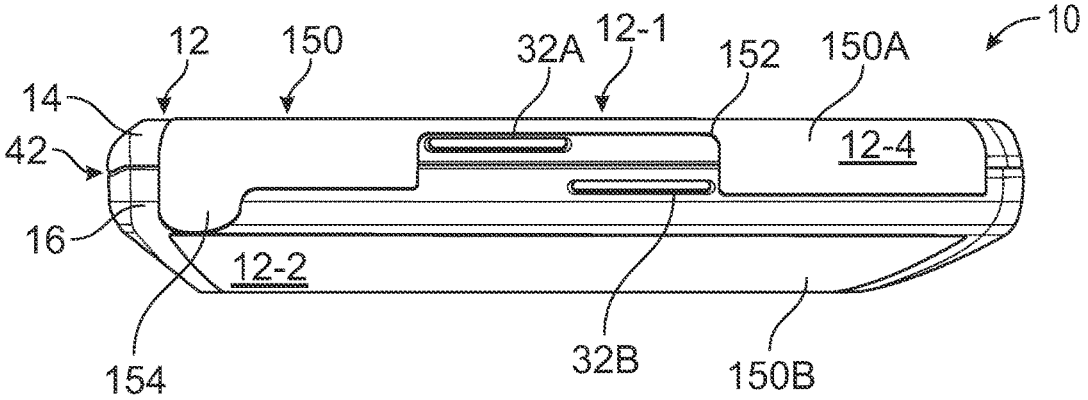
FIG. 7 is a side view similar to FIG. 6 of another storage and display assembly, in accordance with the present disclosure.

With reference to FIG. 7, another configuration of a securement cover 150 is depicted, which may comprise a first part 150A and an optional second part 150B that may be separate from the first part 150A. The first part 150A may extend over at least a portion of the top surface 12-1 and the second side surface 12-4 of the case 12 and across at least a section of a junction 42 between the top and bottom portions 14 and 16. The second part 150B may extend over at least a portion of the bottom surface 12-2 of the case 12. The first and second parts 150A and 150B may stop short of the first and second end surfaces (not labeled) and the first side surface (not visible) of the case 12 so that the hinge and at least a portion of the end surfaces (not visible) are spaced apart from the securement cover 150. The second part 150B may also stop short of the second side surface 12-4 of the case 12. The securement cover 150 may comprise one or more of the polymeric and/or paper materials discussed above and used to form the securement cover 50, and at least a section of the securement cover 150 may be secured to the case 12 with a pressure-sensitive adhesive.

With continued reference to FIG. 7, the securement cover 150 may comprise a cutout 152 that extends inward from an edge and may be positioned over the gripping features 32A and 32B of the case 12, such that the gripping features 32A and 32B are spaced apart from the securement cover 150. The securement cover 150 may optionally comprise a tab 154 extending outward from the edge. The tab 154 may assist with removing the securement cover 150. For example, all or part of the tab 154 may lack adhesive such that the tab 154 is not adhered to the case 12, and the case 12 may be opened by grasping the tab 154 and removing at least a portion of the securement cover 150 from the case 12. In some examples, only the first part 150A of the securement cover 150 may be removed, and the second part 150B may remain adhered to the bottom surface 12-2 of the case 12.

Figure 8:
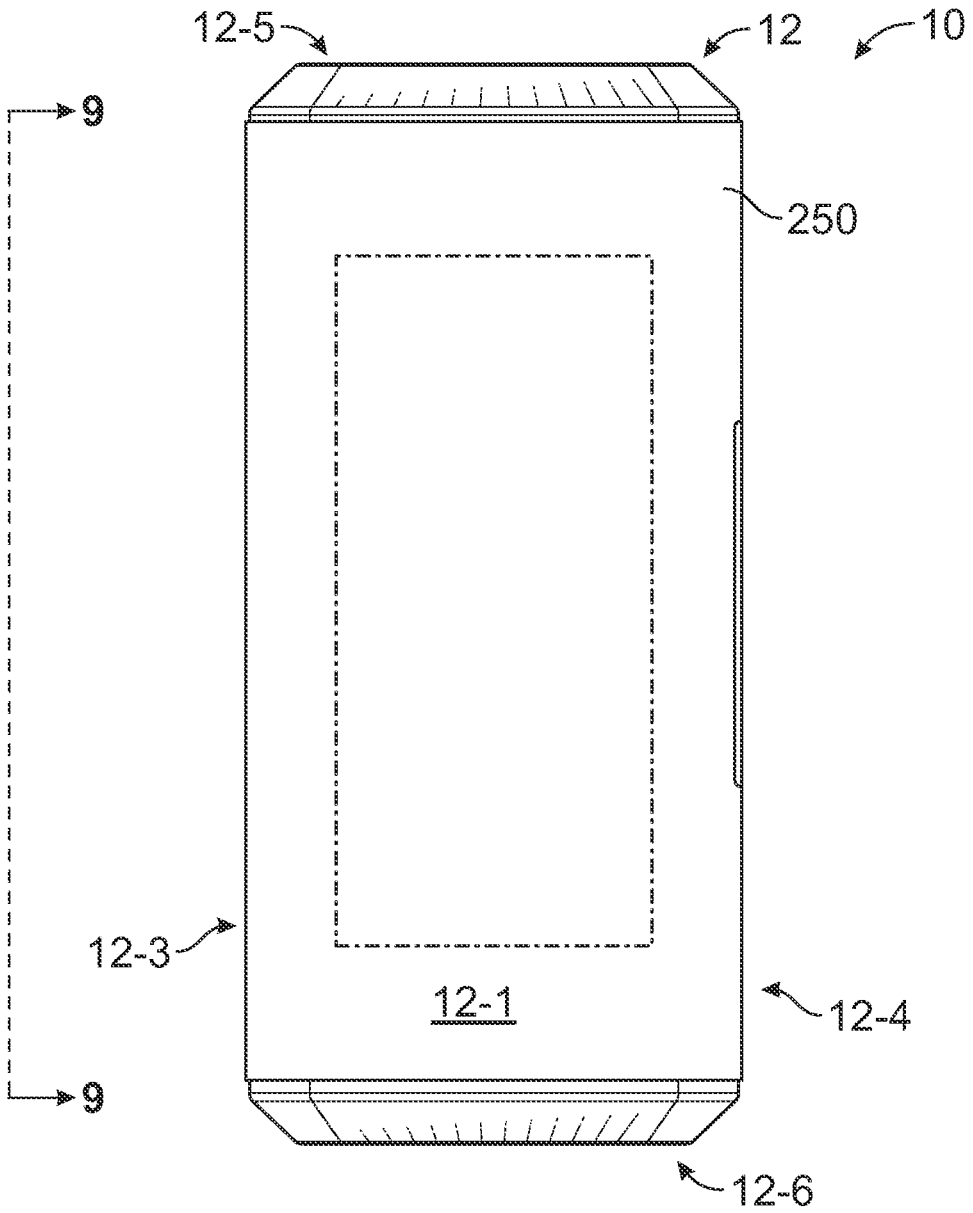
FIG. 8 is a plan view of a storage and display assembly for a shaving razor system comprising a securement cover, in accordance with the present disclosure.
Figure 9:
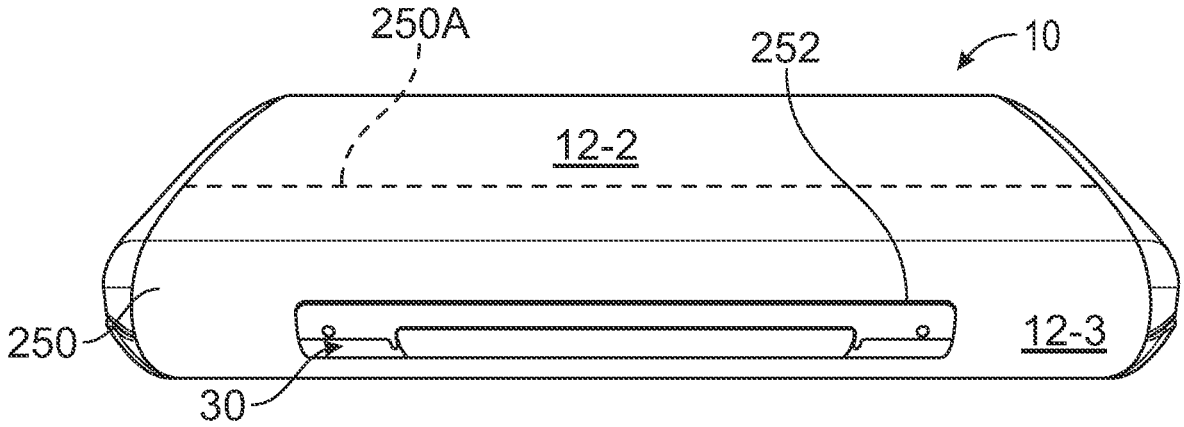
FIG. 9 is a side view taken along view line 9-9 in FIG. 8.

With reference to FIGS. 8 and 9, another configuration of a securement cover 250 is depicted. The securement cover 250 may extend over at least a part of the top and bottom portions 14 and 16 of the case 12 and may extend over at least a portion of the top surface 12-1, the first and second side surfaces 12-3 and 12-4, and the bottom surface 12-2 of the case 12. The securement cover 250 may extend completely around the case 12 and may overlap onto itself on the bottom surface 12-2, as shown in FIG. 9, where an end edge 250A of the cover 250 is shown by a dotted line. The securement cover 250 may comprise one or more of the polymeric and/or paper materials discussed above and used to form the securement cover 50, and at least a section of the securement cover 250 may be secured to the case 12 with a pressure-sensitive adhesive. As seen in FIG. 8, the first and second end surfaces 12-5 and 12-6 of the case 12 may spaced apart from the securement cover 250. Similar to the securement cover 50 shown in FIG. 6, the securement cover 250 in FIG. 8 may comprise an opening (not labeled) that may be positioned over the gripping features (not labeled) so that the gripping features are spaced apart from the securement cover 250. As shown in FIG. 9, the hinge 30 may be spaced apart from the securement cover 250. For example, the securement cover 250 may comprise an opening 252 that may be positioned over the hinge 30 so that the hinge 30 is not covered by the securement cover 250.

Figure 10:
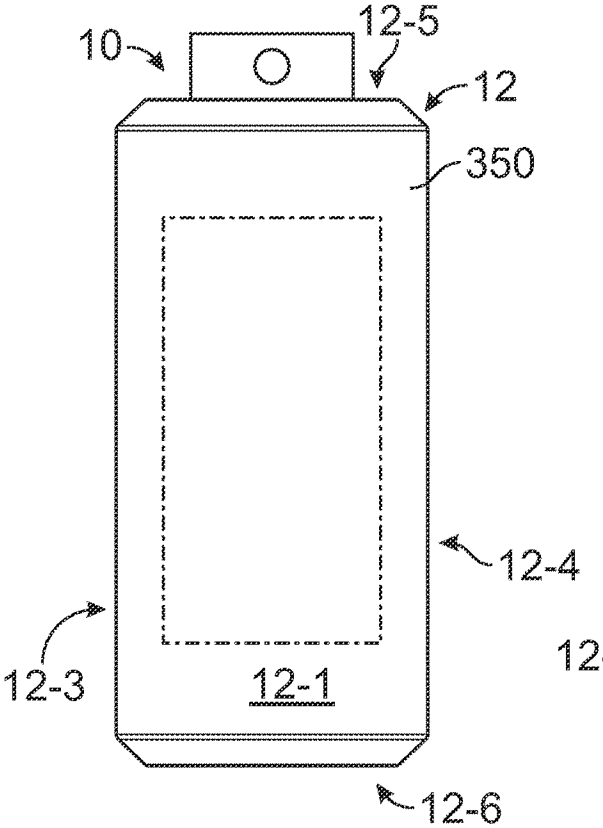

With reference to FIG. 10, another configuration of a securement cover 350 is depicted that may comprise a polymeric shrink film that extends about the case 12. The securement cover 350 may extend over at least a portion of the top surface 12-1 and the bottom surface (not visible) and at least a portion of one or both of the first and second side surfaces 12-3 and 12-4 and the first and second end surfaces 12-5 and 12-6 of the case 12. The securement cover 350 may completely encircle the case 12. In the example shown in FIG. 10, a small portion (not visible) of the first and second end surfaces 12-5 and 12-6 of the case 12 may be spaced apart from the securement cover 350. In other examples (not shown), a small portion of the first and second side surfaces 12-3 and 12-4 may be spaced apart from the securement cover 350 so as not to be covered by the securement cover 350. The securement cover 350 may be formed by placing the case 12 in the closed position on a shrink film sheet or in a shrink film sleeve or tube and causing the shrink film to shrink about the case 12, e.g., by application of heat. The tight fit of the securement cover 350 about the case 12 maintains the case 12 in the closed position and ensures that the securement cover 350 remains associated with the case 12.

Figure 11:
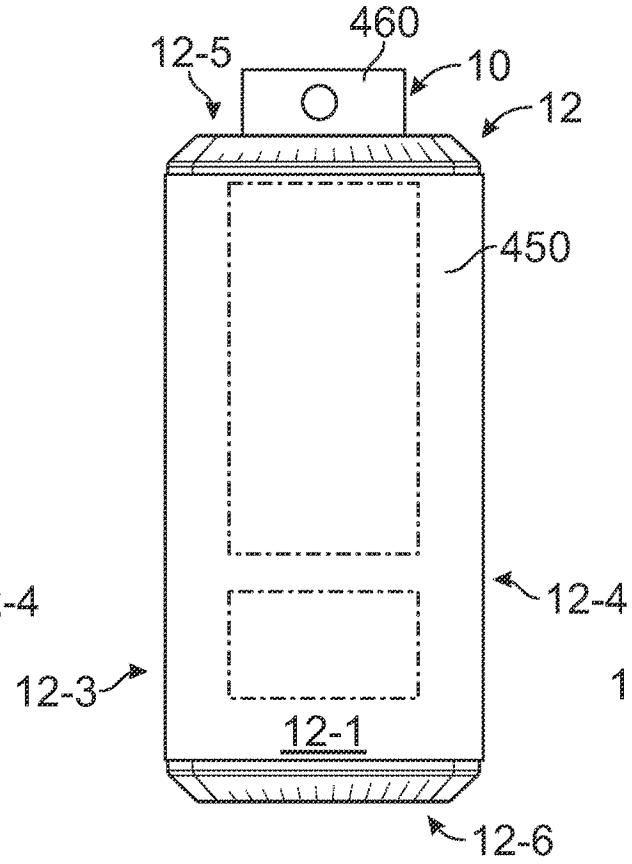

With reference to FIG. 11, another configuration of a securement cover 450 is depicted that may comprise a paperboard or polymeric sleeve that extends about the case 12 such that the sleeve maintains the case 12 in the closed position. The securement cover 450 may extend over at least a part of the top and bottom portions 14 and 16 of the case 12 and may extend over at least a part of the top surface 12-1, the bottom surface (not visible), and the first and second side surfaces 12-3 and 12-4 of the case 12. The first and second end surfaces 12-5 and 12-6 of the case 12 may be spaced apart from the securement cover 450, such that the securement cover 450 may be wrapped about only the pair of side surfaces 12-3 and 12-4 and the end surfaces 12-5 and 12-6 are not covered by the cover 450. The securement cover 450 may overlap itself on the bottom surface of the case 12 and may be secured to the case 12 by securing one or more portions of the securement cover 450 together or by adhesive stickers or labels (not shown). For example, a first longitudinal edge portion (not shown) of the securement cover 450 may overlap a second longitudinal edge portion (not shown) of the securement cover 450, and a conventional adhesive may be provided between the first and second longitudinal edge portions or a label with adhesive may extend across the first and second longitudinal edge portions to secure the longitudinal edge portions together. The securement cover 450 may comprise a hang tag 460, which may be formed as a separate piece that is coupled to the securement cover 450 (e.g., via adhesive or other suitable attachment means) or may be formed as an integral part of the securement cover 450 (see also FIG. 14).

Figure 12:
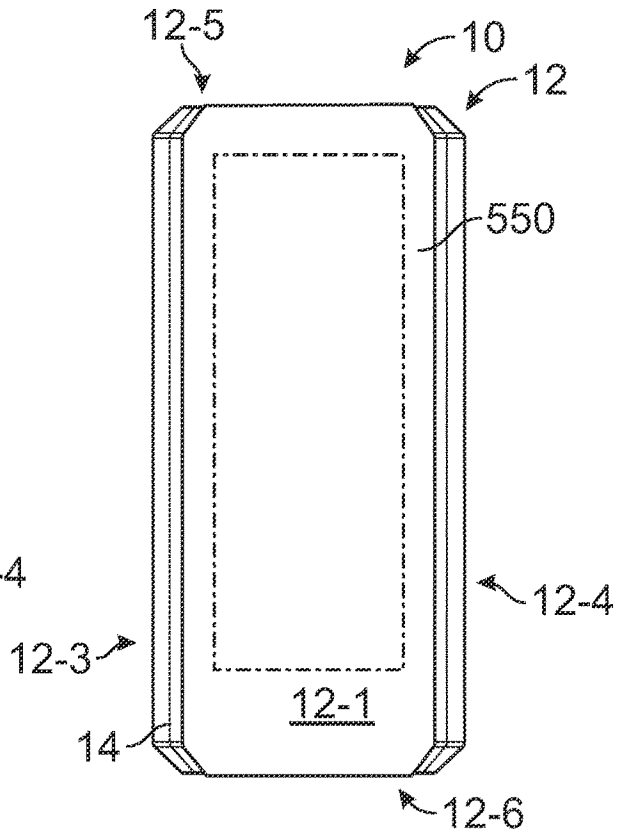
FIGS. 10-13 are plan view of additional storage and display assemblies for a shaving razor system comprising a paperboard securement cover, in accordance with the present disclosure.

With reference to FIG. 12, another configuration of a securement cover 550 is depicted that may comprise a paperboard sleeve that extends about the case 12 such that the sleeve maintains the case 12 in the closed position. The securement cover 550 may extend over at least a part of the top and bottom portions 14 and 16 of the case 12 and may extend over at least a part of the top surface 12-1, the bottom surface (not visible), and the first and second end surfaces 12-5 and 12-6 of the case 12. The first and second side surfaces 12-3 and 12-4 of the case 12 may be spaced apart from the securement cover 550, such that the securement cover 550 may be wrapped about only the pair of end surfaces 12-5 and 12-6 and the first and second side surfaces 12-3 and 12-4 are not covered. The securement cover 550 may overlap itself on the bottom surface of the case 12 and may be secured to the case 12 by securing one or more portions of the securement cover 550 together, i.e., overlapped bottom portions (not shown) of the securement cover 550 may be adhesively secured together, or by adhesive stickers or labels (not shown).

Figure 13:
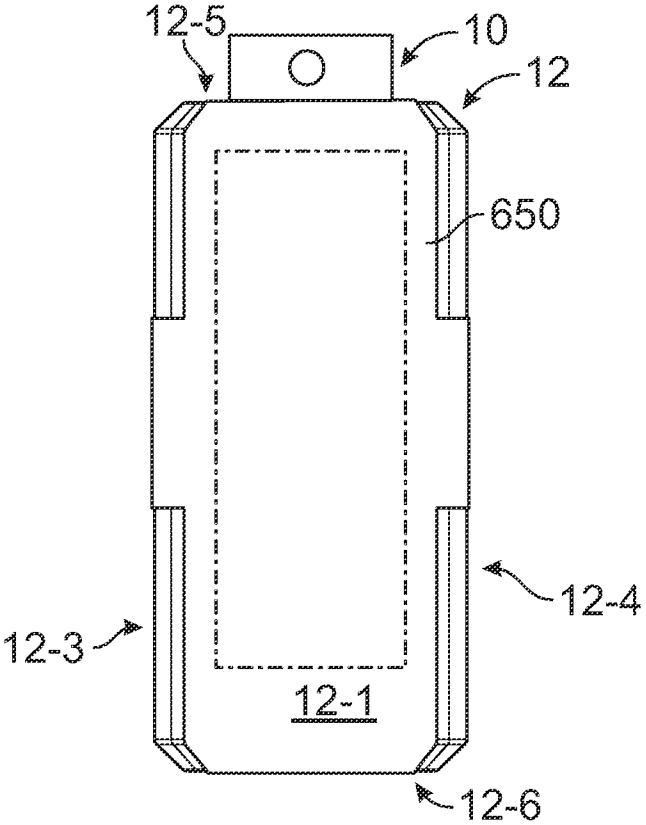

With reference to FIG. 13, another configuration of a securement cover 650 is depicted that may extends about the case 12 to maintain the case 12 in the closed position. The securement cover 650 may comprise paperboard. The securement cover 650 may extend over at least a part of the top and bottom portions 14 and 16 of the case 12 and may extend over at least a part of the top surface 12-1, the bottom surface (not visible), the first and second side surfaces 12-3 and 12-4, and the first and second end surfaces 12-5 and 12-6 of the case 12, such that the securement cover 650 may be wrapped about both of the pairs of side surfaces 12-3 and 12-4 and end surfaces 12-5 and 12-6. In some examples, the securement cover 650 may extend over substantially an entirety of one or both of the pair of side surfaces 12-3 and 12-4 and the pair of end surfaces 12-5 and 12-6 of the case 12. The securement cover 650 may overlap itself and may be secured to the case 12 by securing one or more portions of the securement cover 650 together, i.e., first and second bottom sections (not shown) may overlap and be secured to one another and/or first and second side sections (not shown) may overlap and be secured to one another, or by adhesive stickers or labels (not shown).

Figure 14:
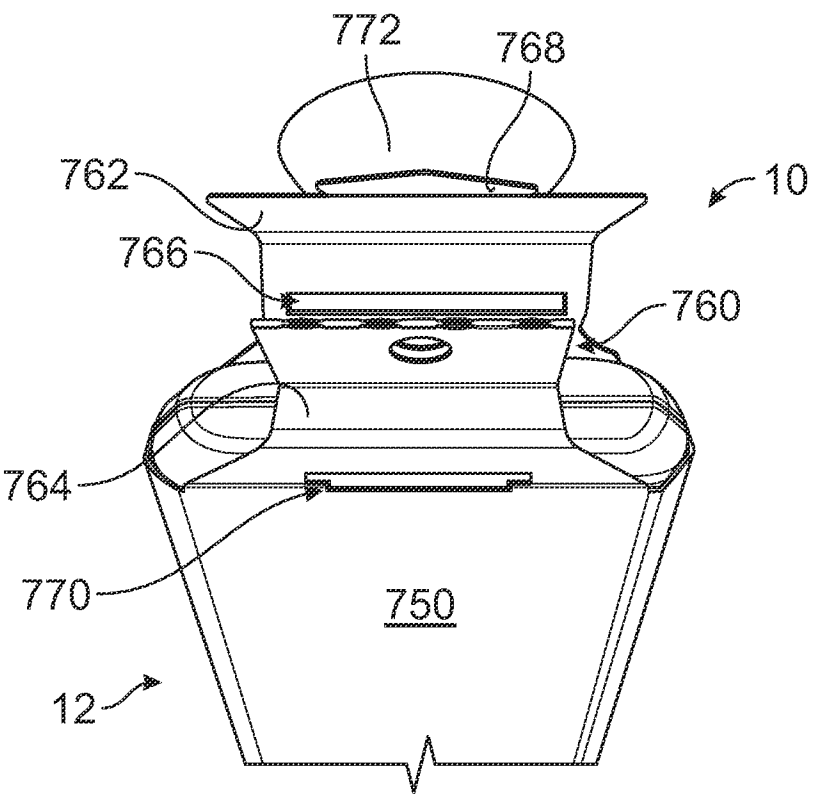
FIG. 14 is a perspective view of a partially assembled hang tag of FIG. 11.

FIG. 14 is a detailed view of a hang tag 760 that may be formed as an integral part of a securement cover 750. First and second extensions 762 and 764 may extend outward from an upper edge of the securement cover 750. The second extension 764 may be configured to fold as shown to form the hang tag 760, and the first extension 762 may be folded over the second extension 764, with the hang tag 760 being received in a first slot 766 formed in the first extension 762. A tab 768 formed on the first extension 762 may be received in a second slot 770, and an adhesive sticker 772 may be used to secure the tab 768 in the second slot 770. The hang tag 760 may be removable, e.g., by separating the hang tag 760 from the securement cover 750 along a perforated line 774.

The storage and display assembly as described herein protects the components of the shaving razor system during shipping and serves as packaging in a retail environment. When the securement cover is associated with the case, between about 25% and about 80% of a surface area of the case may be exposed, in which the surface area of the case comprises a combined surface area of the top, bottom, side and end surfaces. All of part of the securement cover and/or the hang tag are preferably recyclable. In some examples, between about 90% and 100% of the display and storage assembly, by weight, may be reusable (e.g., the case and insert), with only between less than 1% and 5% being disposable or recyclable (e.g., the securement cover and/or hang tag.

Figure 15:
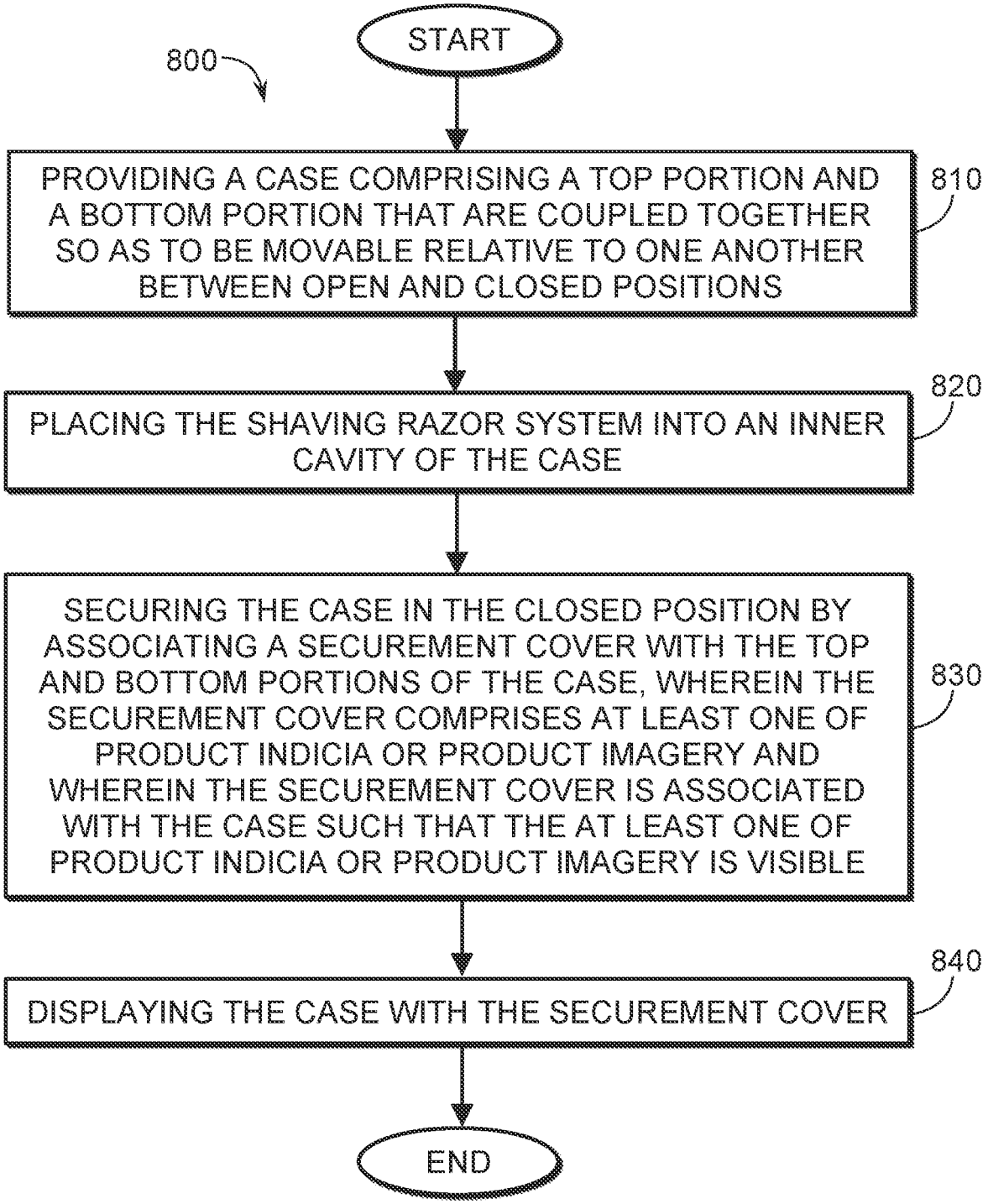
FIGS. 15 and 16 are flow diagrams of methods of merchandizing a storage and display assembly for a shaving razor system, in accordance with the present disclosure.
Figure 16:
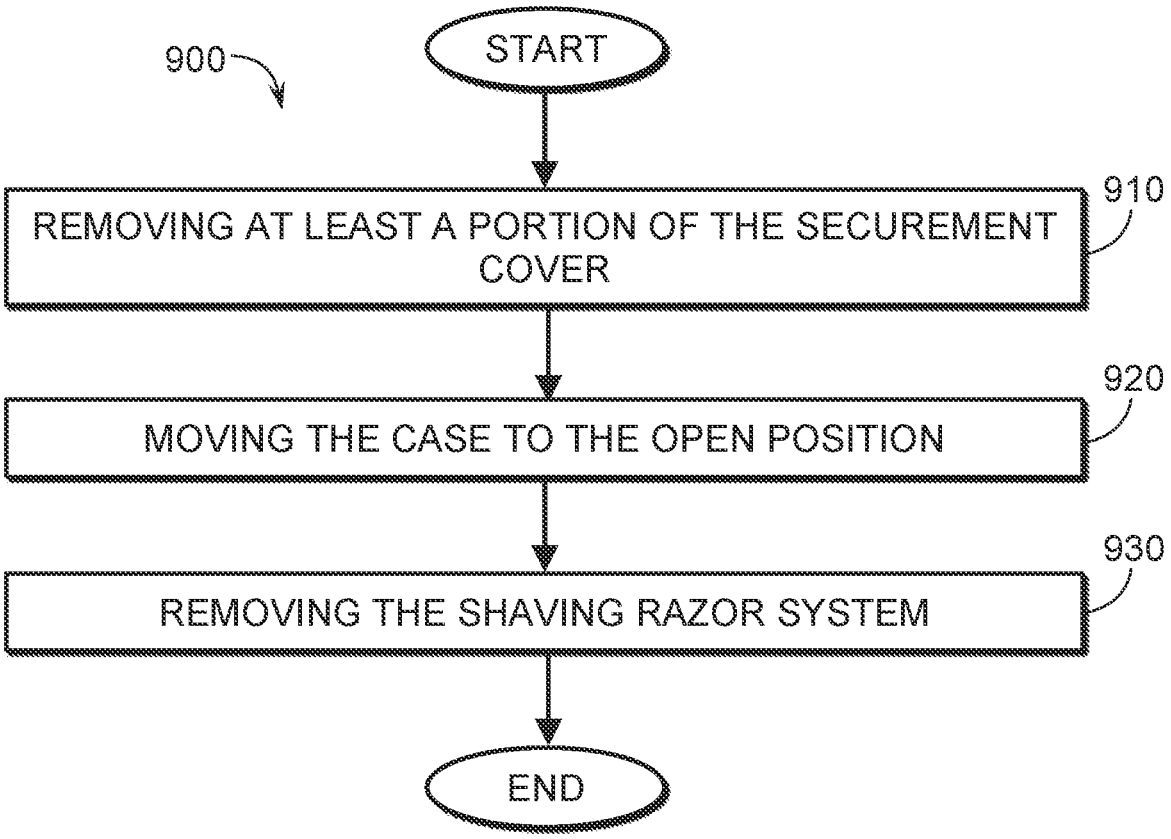

FIGS. 15 and 16 are flow diagrams of methods 800 and 900 of merchandizing a shaving razor system, in accordance with the present disclosure. With reference to FIG. 15, the method 800 begins at Step 810 with providing a case comprising a top portion and a bottom portion that are coupled together so as to be movable relative to one another between open and closed positions. The method continues at Step 820 with placing the shaving razor system into an inner cavity of the case, and securing the case in the closed position at Step 830 by associating a securement cover with the top and bottom portions of the case. The securement cover may comprise at least one of product indicia or product imagery and may be associated with the case such that the at least one of product indicia or product imagery may be visible. At Step 840, the case with the securement cover may be displayed, after which the method 800 may conclude.

FIG. 16 illustrates additional optional steps that may be performed following conclusion of the method 800 in FIG. 15. The method 900 begins with removing at least a portion of the securement cover at Step 910. At Step 920, the case is moved to the open position, and at Step 930, the shaving razor system may be removed, after which the method 900 may conclude.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm" Furthermore, dimensions should not be held to an impossibly high standard of metaphysical identity that does not allow for discrepancies due to typical manufacturing tolerances. Therefore, the term "about" should be interpreted as being within typical manufacturing tolerances.

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A storage and display assembly for a shaving razor system, the assembly comprising:

a case comprising a top portion and a bottom portion, the top and bottom portions being coupled together so as to be movable relative to one another between a closed position and an open position, wherein the top portion of the case is coupled to the bottom portion by a hinge and wherein the top and bottom portions, when in the closed position, define an inner cavity sized to receive the shaving razor system; and a securement cover associated with the top and bottom portions to maintain the top and bottom portions in the closed position, the securement cover being removable from the case to allow the top and bottom portions to be moved to the open position, wherein the top portion of the case comprises one or more first gripping features and the bottom portion of the case comprises one or more second gripping features, the first and second gripping features being configured to assist with moving the case from the closed position to the open position, wherein the securement cover defines an opening positioned around the first and second gripping features and the securement cover is spaced apart from the first and second gripping features.

2. The assembly of claim 1, wherein the securement cover extends over at least a part of the top portion and over at least a part of the bottom portion of the case.

3. The assembly of claim 1, wherein:

the case comprises a top surface, a bottom surface, first and second side surfaces, and first and second end surfaces;

the securement cover extends over at least a part of the top surface, the bottom surface, and at least one of the first side surface or the second side surface; and at least a portion of the first and second end surfaces are spaced apart from the securement cover.

4. The assembly of claim 1, wherein:

the case comprises a top surface, a bottom surface, first and second side surfaces, and first and second end surfaces;

the securement cover extends over at least a part of the top surface, the bottom surface, and at least one of the first end surface or the second end surface; and at least a portion of the first and second side surfaces are spaced apart from the securement cover.

5. The assembly of claim 1, wherein the securement cover comprises a polymeric shrink film that extends about the case and has been caused to shrink about the case to maintain the case in the closed position.

6. The assembly of claim 1, wherein at least a section of the securement cover is secured to the case with a pressure-sensitive adhesive.

7. The assembly of claim 1, wherein the securement cover comprises a paperboard sleeve extending about the case such that the sleeve maintains the case in the closed position.

8. The assembly of claim 7, wherein the case when in the closed position defines a pair of side surfaces and a pair of end surfaces, the paperboard sleeve being wrapped about only one of the pair of side surfaces or the pair of end surfaces.

9. The assembly of claim 7, wherein the case when in the closed position defines a pair of side surfaces and a pair of end surfaces, the paperboard sleeve being wrapped about both of the pairs of side and end surfaces.

10. The assembly of claim 1, wherein the hinge is spaced apart from the securement cover.

11. The assembly of claim 1, wherein one of the top or the bottom portion of the case comprises a first locking element that is adapted to releasably engage with a second locking element on the other of the top or the bottom portion to releasably lock the top and bottom portions in the closed position.

12. The assembly of claim 1, further comprising:

a hang tag associated with the securement cover, wherein the hang tag is configured to allow the case and the securement cover to be displayed or stored.

13. The assembly of claim 12, wherein the hang tag is removable.

14. The assembly of claim 1, further comprising:

a hang tag coupled to the case when the top and bottom portions of the case are in the closed position, wherein the hang tag is configured to allow the case and the securement cover to be displayed or stored.

15. The assembly of claim 1, wherein when the securement cover is associated with the case, between about 25% and about 80% of a surface area of the case is exposed.

* * * * *